United States Patent [19]

Feinberg

[11] 4,102,629

[45] Jul. 25, 1978

[54] EXHAUST STACK DAMPER CONTROL

[75] Inventor: Emanuel Feinberg, Southfield, Mich.

[73] Assignee: Paragon Resources, Inc., Southfield, Mich.

[21] Appl. No.: 733,260

[22] Filed: Oct. 18, 1976

[51] Int. Cl.[2] ..... F23N 3/04

[52] U.S. Cl. ..... 431/20; 431/21; 236/1 G; 126/285 B

[58] Field of Search ..... 431/20; 236/1 G, 45; 126/285 B

[56] References Cited

U.S. PATENT DOCUMENTS

| | | | |
|---|---|---|---|
| 2,085,912 | 7/1937 | Lencke et al. | 236/1 G |
| 2,117,787 | 5/1938 | Bock | 236/1 G |
| 2,698,140 | 12/1954 | Buehler | 431/20 |
| 2,977,437 | 3/1961 | Doane | 236/1 B |
| 3,010,451 | 11/1961 | Hodgins | 431/20 |
| 3,273,625 | 9/1966 | Holtzman et al. | 431/20 |
| 3,500,815 | 3/1970 | De Weese et al. | 126/200 |
| 3,507,267 | 4/1970 | Lafforgue | 126/200 |
| 3,881,462 | 5/1975 | Barnett | 126/200 |
| 3,934,796 | 1/1976 | Smith et al. | 431/20 |
| 4,022,183 | 5/1977 | Martin | 126/200 |
| 4,039,123 | 8/1977 | Frankel | 236/1 G |

FOREIGN PATENT DOCUMENTS

| | | | |
|---|---|---|---|
| 1,289,923 | 2/1962 | France | 431/20 |

*Primary Examiner*—Carroll B. Dority, Jr.
*Attorney, Agent, or Firm*—Krass & Young

[57] ABSTRACT

In a fuel-burning device having a combustion chamber, a burner with a control, an exhaust stack connected to said chamber, an air diverter in said stack and a thermostat connected to said burner control; the improvement which comprises a damper section in the stack downstream of the diverter. The damper is disposed within and journalled upon bearings attached to the damper section. A motor on the damper section has an output shaft connected to the damper and includes a rotary switch on said shaft. An electrical circuit includes a relay switch interconnecting the thermostat, burner control, motor and rotary switch. The motor output shaft is intermittently rotatable through successive arcs of 90°, through 360°, whereby the damper normally closes the stack preventing escape of room air therethrough when the burner is not operating. The thermostat, when calling for heat, closes the circuit to the motor rotating the damper 90° to open position and successively energizing the burner. The thermostat, when no longer calling for heat, closes a portion of the circuit activating the motor causing rotation of the damper an additional 90° in the same direction to stack closing position and to successively deenergize said burner after the damper and rotary switch have rotated several degrees. The damper has a weight biasing it to open position. A fusible link interconnects the motor output shaft and damper whereby, if the burner fails to shut off with the damper closed, hot exhaust gases fuse the link and the damper rotates automatically to open position.

10 Claims, 5 Drawing Figures

FIG. 3
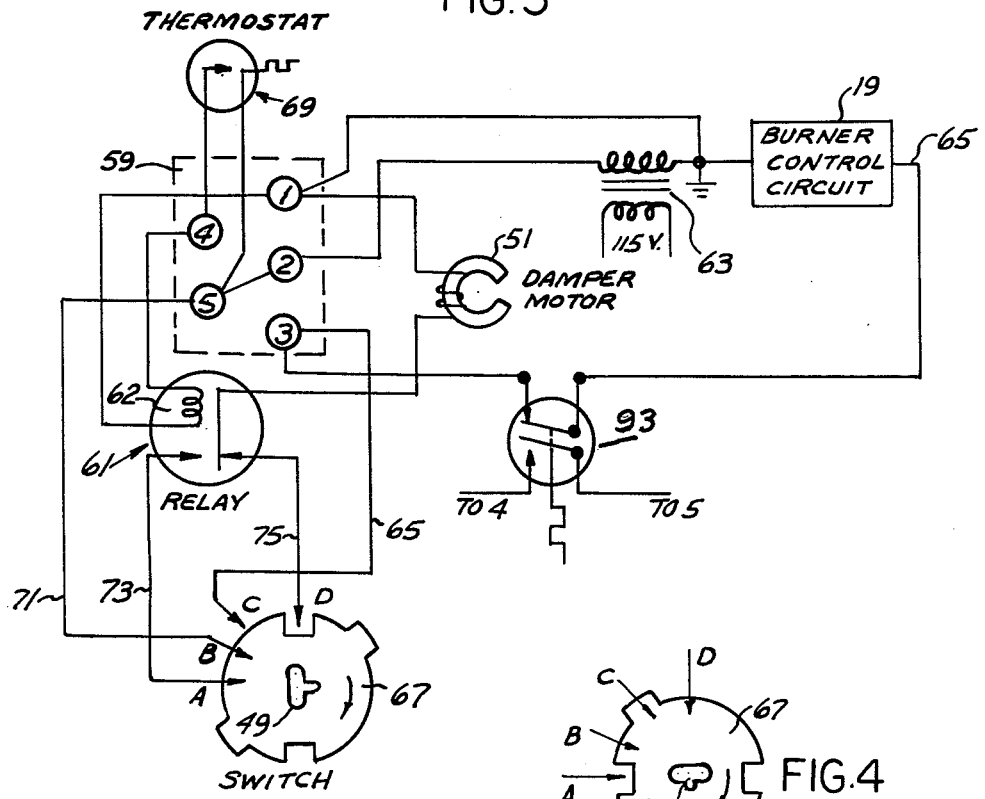
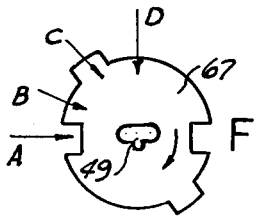
FIG. 4
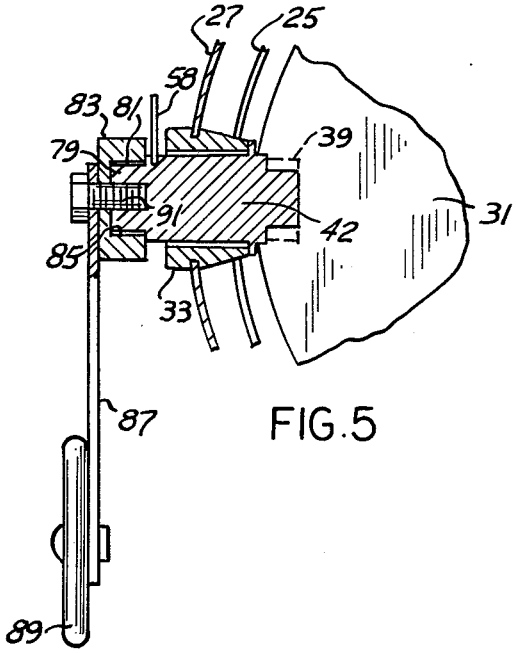
FIG. 5

EXHAUST STACK DAMPER CONTROL

BACKGROUND OF THE INVENTION

Heretofore, various efforts have been made to provide automatic exhaust stack damper controls. Illustrations of this are found in the following Patents:

| PATENTS | ISSUED TO |
|---|---|
| 352,874 | Johnson |
| 684,270 | Kornreich |
| 859,375 | Ehlers |
| 1,591,228 | Obenhaus et al |
| 2,856,922 | Bartels |
| 2,946,554 | Asker et al |
| 3,010,451 | Holzman et al |
| 3,273,625 | Holzman et al |
| 66,582 | 1/1929 - Norway |
| 3,580,238 | Diehl |
| 2,977,437 | Doane. |

The disadvantage of most of these patent disclosures was that the devices are complicated or unsafe or impractical.

BRIEF DESCRIPTION OF THE INVENTION

It is an object of the present invention to provide an improved exchaust stack damper control wherein the damper in the stack is normally closed to prevent escape of heated air therethrough when the burner is not functioning.

It is a further object to provide a positive electric motor control to open the stack damper when the thermostat is calling for heat and to energize the burner and with additional positive control for rotating the damper an additional 90° to damper closing position when the thermostat is no longer calling for heat and the burner is de-energized.

It is a further object to provide a safety mechanism in conjunction with the damper by employing a weight normally biasing the damper to an open position and incorporating a fusible link between the motor output shaft and the damper whereby, if the burner fails to shut down with the damper closed, the link fuses and the damper rotates automatically to open position.

It is a further object to provide a thermo-break heat barrier in the motor output shaft preventing damaging heat transfer from the damper to the motor.

These and other objects will be seen from the following specification and Claims in conjunction with the appended drawings.

THE DRAWINGS

FIG. 3 is a schematic diagram of the electrical circuit which includes the thermostat, the motor, the burner, the relay and rotary switch.

FIG. 4 is a schematic view of the rotary switch disc rotated 90 degrees from the position shown in FIG. 1.

FIG. 5 is a fragmentary side view of an alternate damper counter-weight assembly.

The above drawings illustrate a preferred embodiment of the invention. Additional embodiments are contemplated within the scope of the Claims hereafter set forth.

DETAILED DESCRIPTION OF THE INVENTION

Figure 1:
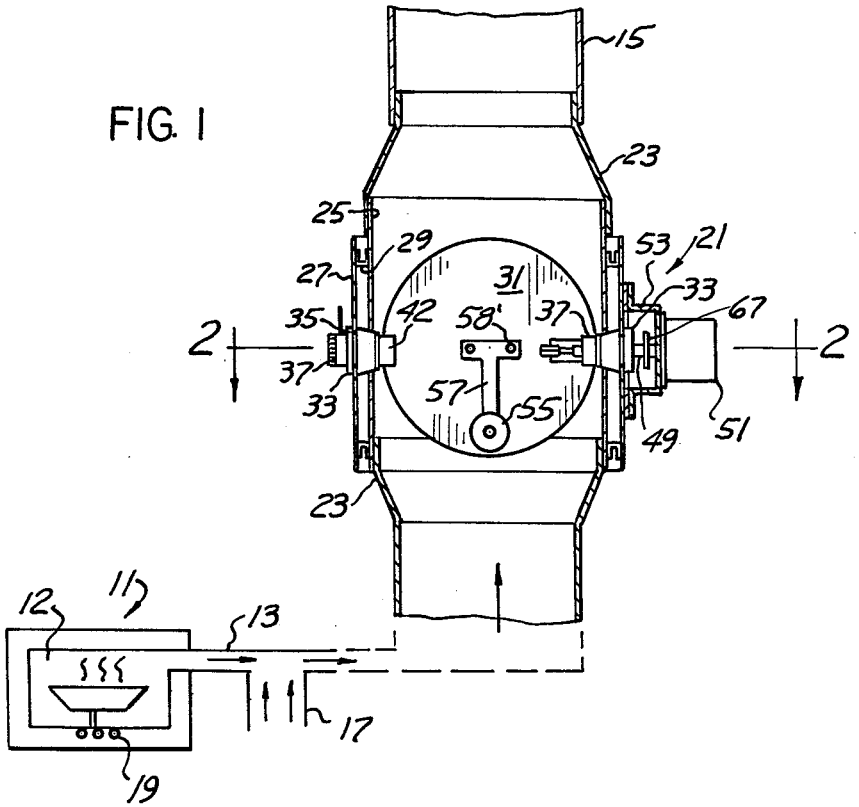
FIG. 1 is a fragmentary schematic elevational view of a fuel burning device having a combustion chamber, a burner and an exhaust stack and incorporating the present exhaust stack damper control.

Referring to the drawing, FIG. 1, a heat exchanger is schematically illustrated at 11, including combustion chamber 12, exhaust pipe 13, stack or vent pipe 15, and air diverter 17. Within the combustion chamber is a conventional burner 19 having suitable burner controls. Damper section 21 is interposed in said stack downstream of air diverter 17, and is suitably connected to the smaller diameter exhaust pipe 15 by the taper fittings 23, above and below said damper section.

The damper section includes cylindrical housing 25 having an outwardly spaced concentric double wall 27 with spacers 29 interposed. Damper 31, FIGS. 1 and 2, is loosely interposed within said housing and loosely journalled therein, as best shown in FIG. 2.

Outer bearings 33 upon opposite sides of the damper section are disposed through corresponding apertures within cylindrical housing 25 and the outer double wall 27. Said bearings include annular notches 35 which anchor the bearings in alignment within said outer wall. Inner bearing 37 has a central aperture and is journalled within bearing 33 and has a pair of upright slots 39 upon its inner portion which receive adjacent portions of the damper. Annular shoulder 40 on the inner bearing retainingly engages an inner portion of the outer bearing 33.

The opposed inner bearing 42 is loosely journalled within the corresponding outer bearing 33 and at its inner end, projects into said damper and through its slots 39 retainingly engages the damper, for rotation therewith. By this construction, damper 31 is loosely journalled within the outer spaced bearings 33.

Figure 2:
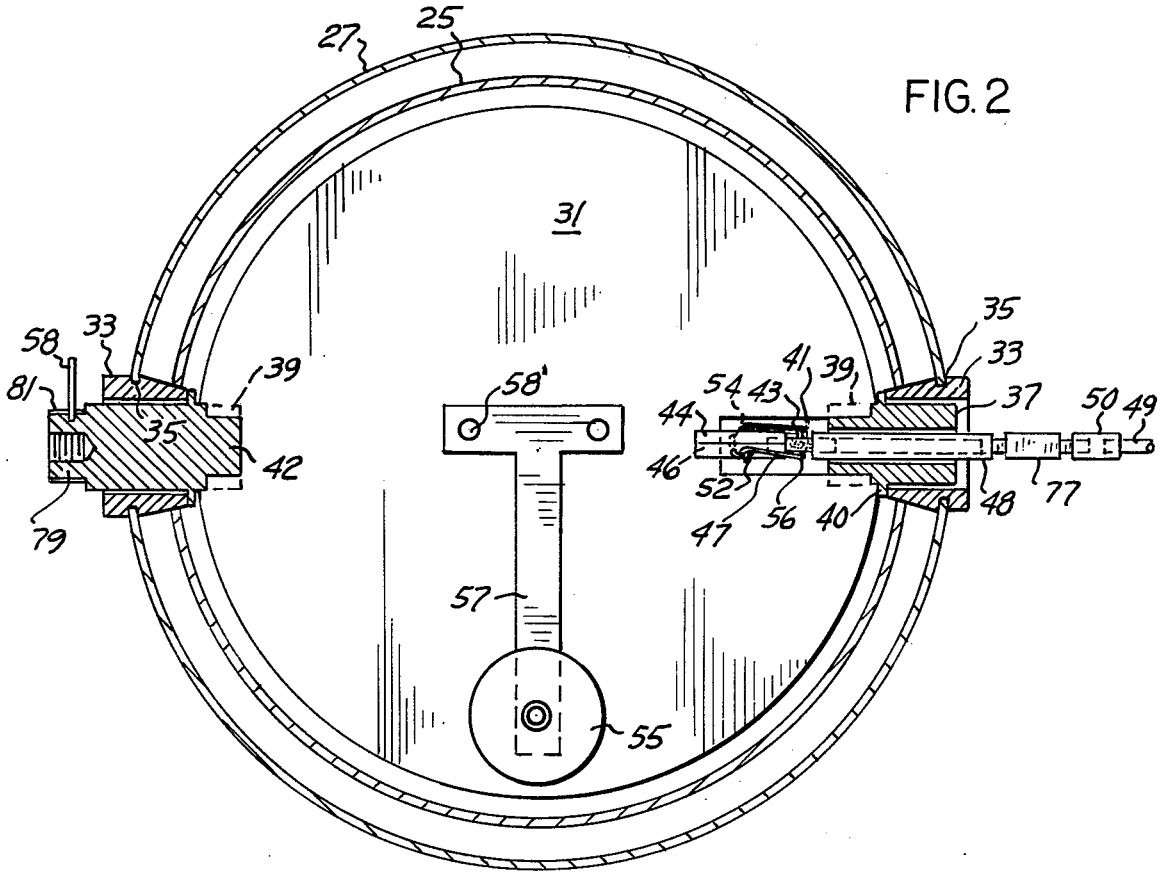
FIG. 2 is a fragmentary plan section taken in the direction of arrows 2—2 of FIG. 1, on an increased scale.

As shown in FIG. 2, upon one side of the damper, there is an enlarged opening 41 within which is loosely nested the fusible link 43. Said link is square in cross section, and as an illustration only, may be made of solder, lead, antimony or bismuth or a combination thereof.

Said link at one end nests within one end of square metal sleeve 44. The other end of said sleeve is slotted at 46 and snugly receives an adjacent portion of damper 31 in driving relation.

The other end of link 43 extends snugly into one end of square metal sleeve 48. The other end of sleeve 48 snugly receives one end of the non-metallic thermo-break element 77. This may be of a fiber or ceramic material, for example, and is square in cross section.

The other end of element 77 extends snugly into the outer end of metal coupling sleeve 50, also square in cross section. The inner end of sleeve 50 receives the flattened end of motor shaft 49 in drive relation.

By this construction, fusible link 43 is easily replaceable.

A link severing spring 47 intermediate its ends is pivotally mounted over the ends of sleeve pin 52 which extends through sleeve 44. The free ends of said spring are anchored at 54 within said sleeve. The bight 56 of the spring operatively bears against fusible link 43.

Said spring assists in the separation of the fusible link when temperatures applied thereto are higher than the established safe limit. This may be in the area of 400° F. approximately depending upon the fuel used.

The thermo-break material 77 reduces transmission of heat from the damper and shaft to the motor.

The enlarged opening 41 adjacent the fusible link permits exhaust gases to pass through the damper should it be in a closed or blocking position, when the burner is on as well as to vent exhaust gases from a free standing pilot flame if one is used.

Motor 51, preferably 24 volts for illustration, includes a mounting bracket 53 by which the motor is supported in insulated relation upon damper section 21, FIG. 1. The counterweight 55 has an adjustable arm 57 secured at 58' to said damper.

Accordingly, as a safety device, in the event with the damper closed, the burner should fail to de-energize, as normally expected, hot exhaust gases would engage the fusible link 43 when passing through the enlarged slot 41 in the damper. On fusing of said link the weight 55 would bias the damper to an upright or otherwise open position with respect to the stack to permit escape of exhaust gases. In any other situation where the damper is closed, when it should be open, the hot exhaust gases from the burner would accomplish the same result. Pin, 58, FIG. 2, indicates actual damper position with respect to flow of vent gases.

FIG. 3 shows a schematic wiring diagram for the circuit which includes the burner 19, and its control, motor 51, and terminal board 59 with contacts 1, 2, 3, 4, and 5. The circuit also includes relay switch 61 and transformer 63 connected to a suitable line voltage such as a 115 volt source. This provides the required voltage for operation of motor 51 and the controls for burner 19.

In this circuit, the lead wire 71 interconnects contact 5 and B contact to the rotary switch 67 which is keyed onto the motor output shaft 49, fragmentarily shown.

Lead 73 interconnects armature control contact of the relay switch 61 and contact A to the rotary switch 67.

Lead 75 connects the other contact of the relay switch and the contact D for the rotary switch 67. IN FIG. 3 contacts C and D are (open) out of engagement with said rotary switch Circuit 65 interconnects 3 on the terminal board 59 with rotary switch contact C. The circuit also connects the burner controls with terminal board contact 3.

The secondary winding of transformer 63 is connected to contacts 1 and 2 on the terminal board and the respective leads from thermostat 69 are Connected to contacts 4 and 5. Relay switch armature 62 is joined to terminal board contacts 1 and 4.

Accordingly, employing the rotary switch 67 on motor output shaft 49 in conjunction with relay 61, burner controls 19, the thermostat 69 and the transformer 63 and motor 51, the action of the thermostat will control automatically the operation of damper motor 51 and the burner and its controls 19. When the thermostat is satisfied and its circuit is open to the respective contacts 4 and 5 corresponding to FIG. 3, the motor 51 and the burner are off. In this connection, a circuit is made between contacts A and B.

The following table shows the normal situations for the respective positions of rotation of the rotary switch 67, for position #1 shown in FIG. 3 as well as successive 90° positions through 360°.

| Degrees Rotation | Pos. No. | 'Stat | Circuit Made | Circuit Open | Motor | Burner |
|---|---|---|---|---|---|---|
| 0 | 1 1 | Satis. | A & B | C & D | Off | Off |
| 90 | 2 | Calling | B,C,D | A | To Off | On |
| 180 | 1A | Satis | A & B | C & D | To Off | Off |

-continued

| Degrees Rotation | Pos. No. | 'Stat | Circuit Made | Circuit Open | Motor | Burner |
|---|---|---|---|---|---|---|
| 270 | 2A | Calling | B,C,D | A | To Off | On |
| 360 | 1 | Satis | A & B | C & D | Off | Off |

Assuming now the thermostat is calling for heat, the circuit through contacts 4 and 5 will be closed, and relay armature energized. Motor 51 is energized and switch 67 rotates 90° from the position shown in FIG. 3 to the position shown in FIG. 4. After 90° rotation under the control of the rotary switch 67, the motor is off but the burner is energized. The motor before turning off has rotated the damper 31 to the open position shown in FIG. 1 to permit the products of combustion to exhaust through stack 15. With the switch 67 in the position of FIG. 4, circuit is made through contacts B, C and D.

Once the thermostat has been satisfied and is no longer calling for heat, the contacts 4 and 5 within the circuit to the thermostat are opened. The normally closed relay contact energizes motor 51 and motor shaft 49 and switch 67 rotates an additional 90°. The burner is de-energized and the damper 31 is in the closed position shown in FIG. 2. Also the motor is de-energized.

By this construction and during all periods when the burner is deactivated, the damper 31 closes the stack 15 in such a manner that heated air from the building does not escape through the air diverter 17, FIG. 1.

Again, when the thermostat calls for heat and the thermostatic switch closes, including contacts 4 and 5 functioning through the relay, the motor is again activated to rotate 90° and the burner is turned on. The circuit is through contacts B, C and D and the circuit is open at contact A. Just as soon as the thermostat is satisfied, the motor will again be activated through the 360° position which corresponds to the zero position, the motor is turned off with the damper closing the stack 15 and the burner is off.

Referring again to the change from position 1 where the thermostat was satisfied:

a. the thermostat makes between 4 and 5, completing the relay circuit which completes the motor circuit through contacts A and B and contacts 5 and 2;

b. the motor rotates until the circuit is broken at A, relay is still actuated through thermostat circuit and burner circuit is made through B anc C at position two; and c. with the thermostat satisfied, relay circuit is broken, the motor circuit makes through contacts A and B, further rotating the damper to the 180° position with respect to FIG. 3 and re-positions the damper to the closed position, FIG. 2, the motor turns off and the burner turns off.

Referring to FIG. 5, there is provided a modified mounting for the counterweight 89 so to be arranged upon the outside of the damper section.

For this construction, bearing upon the side of the damper section opposite the motor mounting has a shoulder 79 of reduced dimension and which has serrations 81 therearound. Said shoulder is adapted to receive the cap 83 whose internal serrations 85 register with the shoulder serrations 81. The assembly is completed by the fastener 91 which extends through the arm 87 through the cap 83 and into bearing 42. The weight 89 is arranged adjustably upon one end of arm 87 and is adapted to bias the damper 31 to an open position. An indicator pin 58 located on the exterior portion of the extended inner bearing between the outer bearing 33 and cap 83 indicates the true position of the damper in relation to the cylindrical damper section 21.

Counterweight 89 will function the same way as counterweight 55. Should, for some reason, the burner fail to turn off when the damper is closed, such as in the position shown in FIG. 2, the hot exhaust gases passing through the damper aperture 41 will cause the fusible link 46 to fuse so as to disengage the damper 31 from shaft 49. Weight 89 is thus effective to rotate the damper to the upright open position shown in FIG. 1, or to such position as opens said damper. Counterweight 89 is not subject to corrosion from flue gases.

An optional safety thermostat 93 may be interposed in the circuit 65, FIG. 3, to and from the burner and is arranged within the cylindrical damper section 21 on the upstream or burner side of the damper. The thermostat is arranged to close at approximately 400° F., or at a predetermined point between the normal operating vent temperatures at which the fail-safe link 43 fails. This will thus cause the motor to rotate the damper to a full open position should that temperature be reached and at the same time, opening the burner control circuit.

The construction shown in FIG. 2 with the oversized slot 41 through the damper 31 provides a means by which the fusible link 43 may be easily replaced. Said fusible link and journalling of damper independent of drive shaft 49 builds into the control mechanism a safety feature by which, for any reason whatever, the damper be closed when the burner is operating, the link will be fused and the pre-positioned counterweight 55 or 89 will be effective to rotate the damper to an open position to permit the escape of exhaust gases through stack 15.

It is contemplated, furthermore, that should the stack be on some angle other than perfectly upright the damper will be adjusted in accordance with the angle of the stack in alignment therewith when the stack is to be opened and transversely thereof when the stack is closed, either under the control of the motor 51 or the safety counterweight 55 or 89.

Having described my invention, reference should now be had to the following claims:

I claim:

1. An automatic exhaust stack damper device for a combustion heating device of the type having a burner disposed in a combustion chamber and an exhaust stack for exhausting the products of combustion from said combustion chamber, said automatic exhaust stack damper device comprising:

a damper section mounted to form a section of said exhaust stack;

a damper movably mounted in said damper section and adapted to allow the passage of said combustion gases in an open position and upon moving to a closed position, adapted to substantially close said exhaust stack;

damper motor means operative when activated to move said damper to said closed position;

bias means urging said damper to said open position, said damper motor acting to overcome said bias means and move said damper to said closed position;

burner control means activating said damper motor means when said burner operation is discontinued;

fusible means mounted to be heated by said combustion gases exhausted through said exhaust stack, said fusible means comprising an element which melts upon reaching a predetermined temperature in said exhaust stack, said predetermined temperature corresponding to the operation of said burner with said damper in said closed position;

means for causing opening of said damper by said bias means upon melting of said fusible means element, not withstanding said damper motor being activated, whereby said automatic exhaust stack damper is fail safe in that in the event of burner operation with said damper motor activated due to system malfunction, said damper is opened by said bias means.

2. The automatic exhaust stack damper device according to claim 1 said fusible means element being a fusible link between and drivingly interconnecting said damper and said motor.

3. The automatic exhaust stack damper device according to claim 1 said biasing means being a counterweight adjustably connected to said damper.

4. The automatic exhaust stack damper device according to claim 1 including an oversized opening through said damper permitting passage of exhaust gases therethrough, if the damper is closed.

5. The automatic exhaust stack damper device according to claim 1 including an oversized opening through said damper permitting passage of exhaust gases therethrough, if the damper is closed, and said fusible means element being nested within said oversized opening.

6. The automatic exhaust stack damper device according to claim 1 including a first metal sleeve of square cross section at one end connected to said damper, said fusible means element being of square cross section and at one end projecting into the other end of said first sleeve and a second metal sleeve of similar shape receiving at one end the other end of said fusible link, the other end of said second sleeve being connected to said motor shaft.

7. The automatic exhaust stack damper device according to claim 1 said biasing means being a counterweight located upon the exterior of said damper section, and secured to said damper for rotation therewith, and adjustable in position so as to cause the damper to fall into a full open mode regardless of the angle at which the damper section is installed.

8. The automatic exhaust stack damper device according to claim 1, including aligned opposed outer bearings nested within opposed wall portions of said damper section; and opposed inner bearings extending into and engaging said outer bearings and secured to said damper, one inner bearing being axially apertured to loosely receive said motor shaft.

9. The automatic exhaust stack damper device according to claim 1, said fusible means element being a fusible link connected to said motor for interrupting the driving connection between said motor and said damper, said biasing means rotating the damper to full open position upon interruption of said driving connection if said damper is initially in the closed position upon melting of said fusible link.

10. The automatic exhaust stack damper device according to claim 1 wherein said burner control means includes means whereby said burner operation is not enabled until said damper is in the open position.

* * * * *

UNITED STATES PATENT OFFICE

CERTIFICATE OF CORRECTION

Patent No. 4,102,629 Dated July 25, 1978

Inventor(s) Emanuel Feinberg

It is certified that error appears in the above-identified patent and that said Letters Patent are hereby corrected as shown below:

Column 3, line 67 "11" should be -- 1 --.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*